US005735057A

United States Patent [19]

Morford

[11] Patent Number: 5,735,057

[45] Date of Patent: Apr. 7, 1998

[54] SHINGLE GAUGE

[76] Inventor: Duane H. Morford, 2716 SE. Michigan St., Topeka, Kans. 66605

[21] Appl. No.: 687,917

[22] Filed: Jul. 29, 1996

[51] Int. Cl.[6] ..... G01D 21/00; B25F 1/00

[52] U.S. Cl. ..... 33/648; 33/649; 33/647; 7/122; 52/DIG. 1; 81/45

[58] Field of Search ..... 33/648, 649, 647, 33/646; 7/122; 81/45; D8/81, 78; 52/DIG. 1

[56] References Cited

U.S. PATENT DOCUMENTS

| | | | |
|---|---|---|---|
| 832,962 | 10/1906 | Fellows | 53/648 |
| 1,701,904 | 2/1929 | Ailor | 7/122 |
| 2,004,839 | 6/1935 | Steien | 33/648 |
| 2,517,345 | 8/1950 | Pies . | |
| 2,596,558 | 5/1952 | Ingram | 33/648 |
| 2,807,094 | 9/1957 | Neuber | 33/648 |
| 2,966,745 | 1/1961 | Erickson | 33/648 |

*Primary Examiner*—Christopher W. Fulton
*Attorney, Agent, or Firm*—Kenneth W. Iles

[57] ABSTRACT

A shingle gauge includes a circular collar that is adjustable secured to the hammerhead of a conventional hammer and includes a pair of rearwardly projecting side rails, which are connected by a stud having a cylindrically headed nuts fastened outside the side rails. The distance between the cylindrically headed nuts and a front edge of the shingle gauge is used to measure the desired distance between adjacent rows of shingles fastened to a roof.

5 Claims, 2 Drawing Sheets

SHINGLE GAUGE

BACKGROUND OF THE INVENTION

1. Field of the Invention

The present invention is related to an apparatus for positioning shingles sequentially when roofing a structure, such as a house. More particularly, the present invention is directed to a device that fits onto a conventional claw hammer that allows the roofer to accurately gauge the horizontal and vertical distances between rows of shingles, while still fully using the hammer in the ordinary fashion.

2. Description of Related Art Including Information Disclosed Under 37 C.F.R. Sections 1.97–1.99

Structures having sloped roofs, such as a house, generally have a roof covered with shingles. Each shingle is individually installed by nails hammered through the shingle into some type of underlying supporting structure, such as plywood or runners. Shingles are normally placed on the roof in rows and the distance the next higher row of shingles is spaced from the front edge of the row immediately below must be the same for each row so that the finished roof presents a uniform and pleasing pattern. It is typical to use some type of gauge for measuring the distance between rows of shingles and between columns of shingles.

A hammer or hatchet is typically used to install the shingles. A separate tool, such as a ruler or gauge, can be used for measuring the distances between adjacent shingles, but a separate tool can be easily lost and slows the work of roofing, as one tool must be set down and anther picked up each time that a new shingle is installed.

It is known to provide a shingle hatchet with a pair of spaced marking member that protrude from a side of the hatchet head that serve as a shingle gauge, as disclosed in U.S. Pat. No. 2,596,558. Use of this device requires laying the hatchet head down parallel with the plane of the shingles with the sharp edge of the hatchet pointed at the roofer, presenting a safety hazard. Further, a roofing hatchet is needed only when installing wooden shingles, but most roofs are covered with composition or asphalt shingles. Roofing hatchets are expensive, are easily and commonly lost, and their use is unnecessarily dangerous when there is no use for the sharp cutting edge of the hatchet. The gauge members that protrude from the hatchet head present a safety hazard by exposing the roofer to the risk of injury from the gauge members themselves.

U.S. Pat. No. 2,517,345 discloses a bolt having a flange on its outer edge and the is screwed into a threaded recess in the hammerhead. A locking nut secures the gauge at a desirable distance. The length of the gauge must be set by the roofer and can change during use without his knowledge. Further, a special hammer is required.

U.S. Pat. No. 2,004,839 discloses a shingle gauge that fits completely along the handle of a claw hammer. This shingle gauge prevents the roofer from gripping or using the bulk of the length of the hammer handle. Further, this gauge must be installed on a hammer handle at a specific measured place because the top surface of the hammerhead is used for one end of the gauge. If the installed gauge slips, the roofer will unknowingly mis-measure the shingle rows. U.S. Pat. No. 1,701,904 discloses a shingle gauge that is secured to the handle of a claw hammer and suffers from the same difficulties as U.S. Pat. No. 2,004,839.

All of the solutions to the problems involved in setting shingles at uniform distances that are reflected in the inventions referenced above have shortcomings. They either require use of unnecessary tools in some cases, inhibit use of a hammer for driving nails, require a special hammer, or include a gauge that can slip during use, leading to non-uniform spacing between singles.

Therefore, there is a need for a shingle gauge that can be used with a conventional hammer; that allows the hammer to be used for driving nails without hampering use of the hammer; and that cannot slip to alter the distance being measured during use.

SUMMARY OF THE INVENTION

Accordingly, it is a primary object of the present invention to provide a shingle gauge that can be used with conventional hammers.

It is another object of the present invention to provide a shingle gauge that allows the hammer to be used for driving nails without hampering use of the hammer.

It is another object of the present invention to provide a shingle gauge that cannot slip to alter the distance being measured during use.

A shingle gauge according to the present invention includes a circular shaped front collar portion secured to the hammer head by a bolt fastened through a pair of aligned apertures in a pair of depending flanges extending from the collar portion. A pair of side rails extend rearwardly of the front collar, with one side rail on each side of the hammerhead. A stud or bolt crosses between the two side rails, strengthening them. A circular headed nut is fastened to each end of the stud, providing an indexing member. The distance between the front of the circular collar and the indexing members is used to measure the distance between adjacent rows of shingles when roofing a structure.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
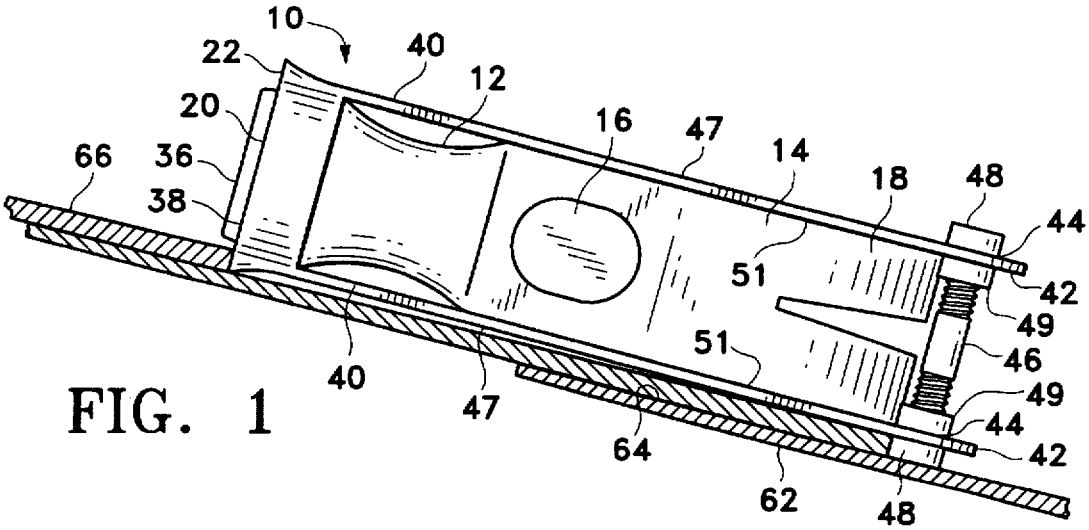
FIG. 1 is a top plan view of a shingle gauge according to the present invention, showing the shingle gauge attached to a claw hammer and being used to gauge the distance between rows of shingles.
Figure 2:
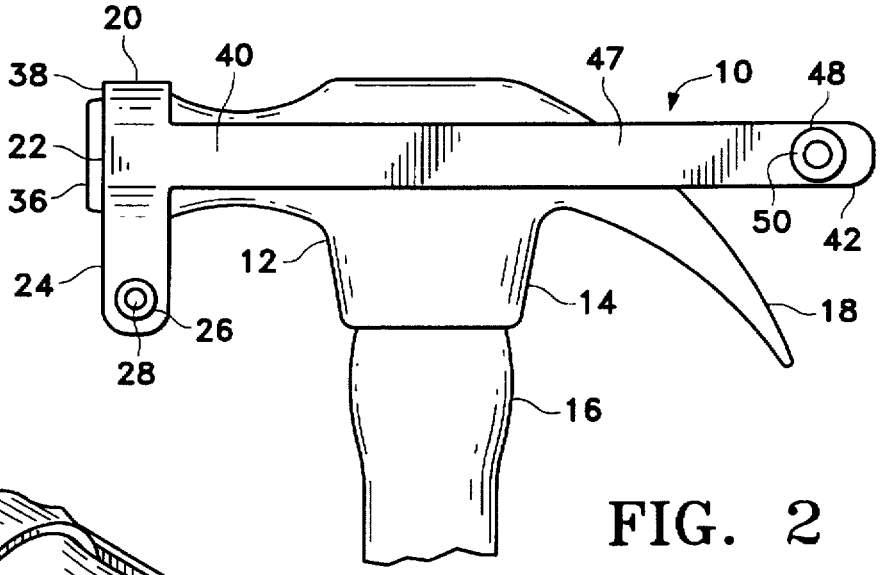
FIG. 2 is a partial side elevation of the attached shingle gauge and hammer assembly of FIG. 1.
Figure 3:
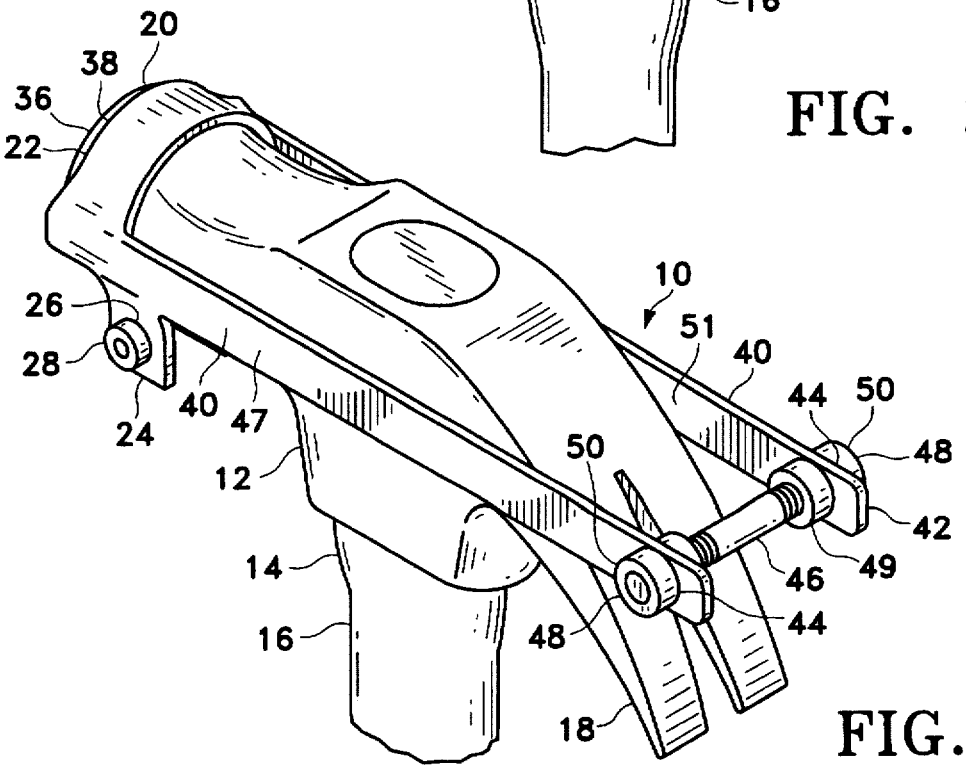
FIG. 3 is a right-hand rear perspective view of the attached shingle gauge and hammer assembly of FIG. 1.

Referring to FIGS. 1–3, there is shown a shingle gauge 10 attached to the head 12 of a hammer 14 having a handle 16 and an integral claw member 18. The handle 16 may be wood, steel, fiberglass or the like. The hammerhead 12 is normally steel and the shingle gauge is adapted to fit on any conventionally shaped and sized hammerhead. The shingle gauge 10 is adapted for fitting about the perimeter of the sides of the striking surface on a conventional hammerhead, as shown in FIGS. 1–3. The shape or nature of the claw member 18 is irrelevant to adaptability of the shingle gauge 10 to a standard hammer and may be attached to a hammer that does not have a claw.

Figure 4:
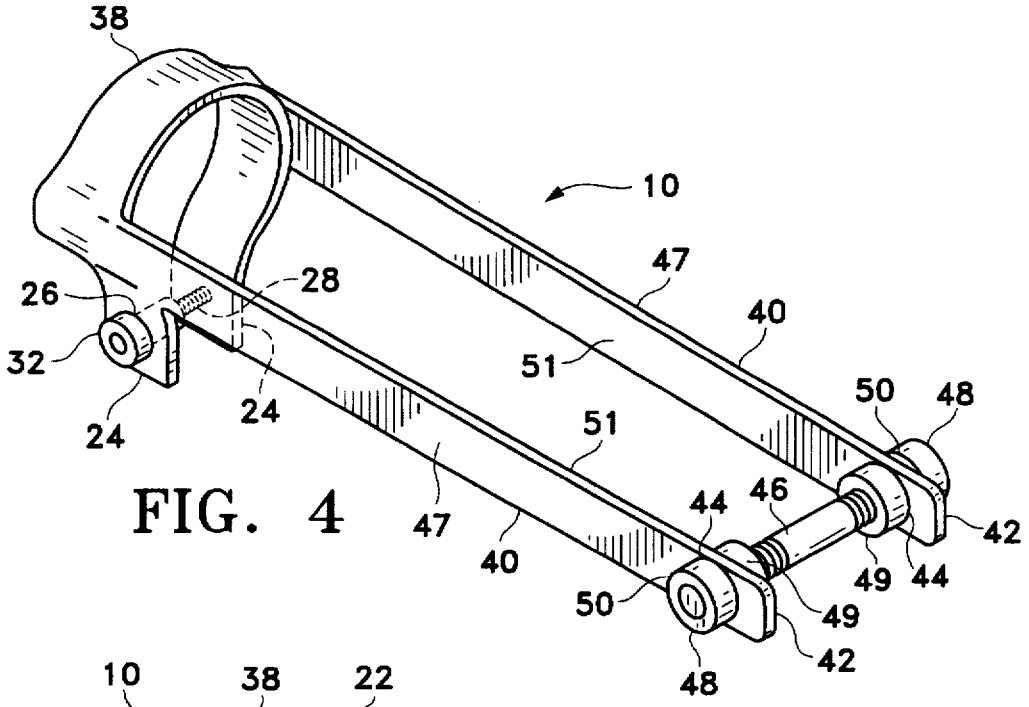
FIG. 4 is right-hand rear perspective view of a shingle gauge according to the present invention.
Figure 5:
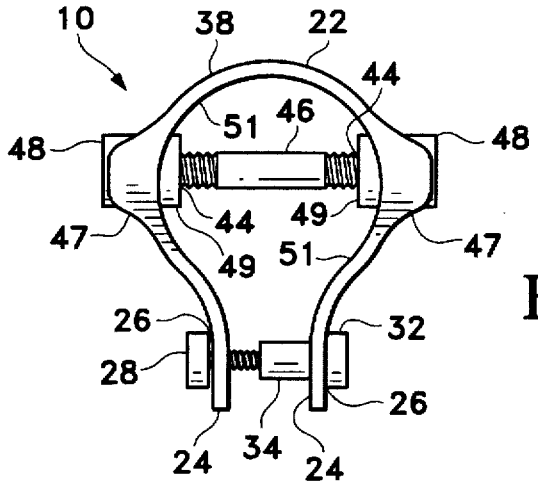
FIG. 5 is a front elevation of the shingle gauge of FIG. 4.

The front portion 20 of the shingle gauge 10 includes a substantially circular collar portion 22 having a pair of spaced depending flange members 24 (FIGS. 4 and 5), each flange member including an aperture 26, with the two apertures aligned for insertion of a threaded clamping member. A bolt 28 having a head 30 is inserted through one aperture 26 and is threaded into a nut 32 having a cylindrical body 34 that is received in the other aperture 26. The circular collar portion is fitted over the head 12 of the hammer 14 and the bolt 28 is used for adjustably drawing said two depending flange members toward one another by tightening the nut 32 onto the bolt 28 to secure the shingle gauge tightly to the hammerhead 12. The circular collar portion 22 fitting allows the same shingle gauge 10 to be used with hammerheads having somewhat different dimensions. The shingle gauge 10 can be located at any position along the head 12 so long as the face 36 of the hammer 12 is not recessed from the front edge 38 of the shingle gauge 10. This allows the hammer to be used for driving nails as if the shingle gauge 10 were not attached to it.

A pair of opposed parallel side rails 40 extend rearwardly from the font edge 38 of the collar portion 22 of the shingle gauge 10, with one rearwardly extending side rail 40 lying along each side of the hammerhead. Adjacent to a distal end 42 of each side rail 40 is an aperture 44, through which a stud 46 is inserted, with a cylindrically headed nut 48 threadedably attached to each outer end of the stud 46 adjacent to an outside surface 47 of each side rail 40. A jam nut 49 is threaded onto each of the threaded ends of the stud 46 adjacent to an inner surface 51 of each side rail 40. Each jam nut 49 is tightened against the corresponding side rail 40 and cylindrical headed nut 48. This arrangement allows the distance between the two side rails 40 to be adjusted to accommodate hammerheads of different widths.

Figure 6:
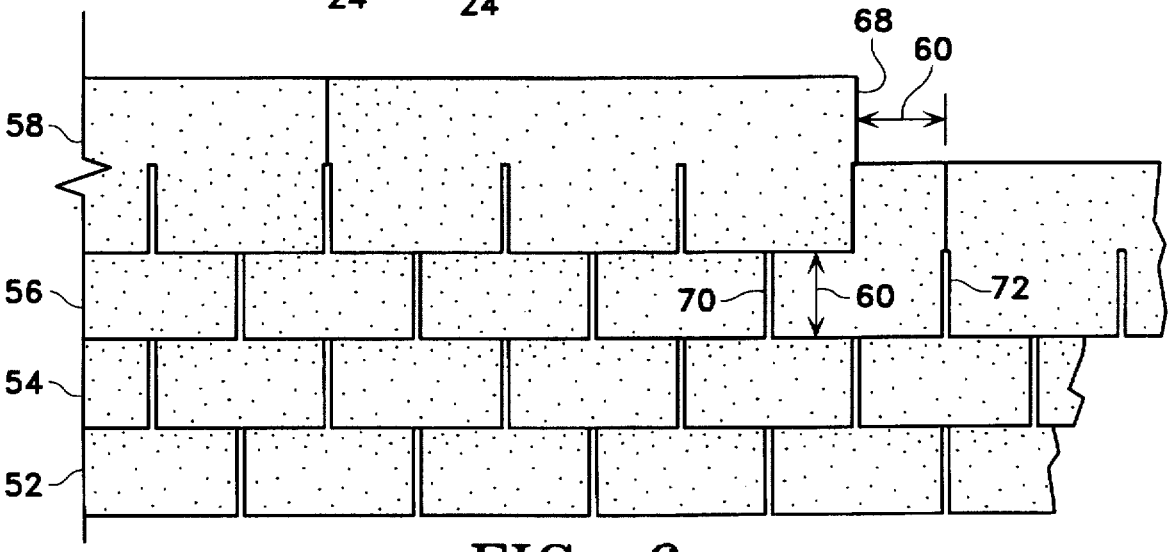
FIG. 6 is a top plan view of a roof in the process of being covered with shingles.

Referring now to FIGS. 1 and 6, the distance between the front edge 38 and the closest surface 50 of either cylindrical nut heads 48, which serve as indexing members protruding outwardly from each side rail 40, is preset at the desired distance between adjacent rows of shingles 52, 52, 54, 58, which is normally 5⅛ inches (13.0175 cm). In use, the hammerhead 12 is laid on its side and the shingle gauge 10 is used to measure and set the distances between adjacent rows and columns of shingles as shown by the arrow sets 60. As best seen in FIG. 1, the surface 50 of a cylindrical headed nut 48 is placed against the lower edge 62 of a shingle 64 and the next higher adjacent shingle 66 is placed with its lower edge against the front edge 38 of the shingle gauge 10. Referring to FIG. 6, the same technique is used to align the edge 68 halfway between the slots 70, 72 in the shingle below the layer being applied.

The shingle gauge 10 may be made from metal welded or bolted together, or may be made substantially from plastic, resin, or the like. The gauge's measuring distance may, of course be different for different purposes. Providing a pair of cylindrically headed nuts 48 allows the shingle gauge 10 to be used conveniently by either left-handed or right-handed and it does not matter which side of the hammerhead 12 is laid down when using the shingle gauge 10. Another embodiment of the shingle gauge 10 includes only one side rail 40, which Simplifies construction, but does not include the rigidity and strength of the preferred embodiment disclosed in detail herein.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A shingle gauge comprising a circular collar portion adapted for fitting about the perimeter of the sides of the striking surface on a conventional hammerhead, a pair of spaced parallel side rails each having a front end connected to said circular collar portion and extending toward the rear of the hammerhead, with one said side rail lying on a left-hand side of the hammerhead and one said side rail lying on a right-hand side of the hammerhead, each said side rail having distal end, said distal ends of said side rails extending to a point not in contact with said hammerhead, means for determining a fixed distance from said front circular portion and means for securing said circular collar portion to a hammerhead.

2. A shingle gauge in accordance with claim 1 wherein said front circular collar portion securing means further comprises a pair of spaced parallel depending flange members extending from a pair of ends of said circular collar portion and a means for adjustably drawing said two depending flange members toward one another without allowing said flange members to contact one another.

3. A shingle gauge in accordance with claim 1 wherein said means for determining a fixed distance from said front circular portion further comprises an indexing member protruding outwardly from each said side rail.

4. A shingle gauge in accordance with claim 3 wherein said means for determining a fixed distance from said front circular portion fixed to each said side rail further comprises a stud mounted in an aperture in each said side rail, said two apertures lying in alignment with one another and each being adjacent to a distal end of each said side rail, said stud being secured by a circular headed nut on each of two ends of said stud.

5. A shingle gauge comprising a circular collar portion adapted for fitting about the perimeter of the sides of the striking surface on a conventional hammerhead, two parallel rearwardly extending side rails projecting from said circular collar portion, with one said rearwardly extending side rail lying along each side of the hammerhead, an indexing member protruding outwardly from each side rail and attached thereto, a stud mounted in an aperture in each said side rail, said two apertures lying in alignment with one another and each being adjacent to a distal end of each said side rail, said stud being secured by a circular headed nut on each of two ends of said stud and means for securing said circular collar portion to a hammerhead.

* * * * *